United States Patent [19]
Camardella
[11] 4,294,417
[45] Oct. 13, 1981

[54] STATIC WIRE TENSIONER FOR COIL WINDING MACHINES

[75] Inventor: Giuseppe Camardella, Saronno, Italy

[73] Assignee: Tekma Kinomat S.p.A., Caronno Pertusella, Italy

[21] Appl. No.: 95,940

[22] Filed: Nov. 20, 1979

[30] Foreign Application Priority Data

Nov. 24, 1978 [IT] Italy ..... 30141 A/78

[51] Int. Cl.[3] ..... B65H 59/22
[52] U.S. Cl. ..... 242/149
[58] Field of Search ..... 242/150 R, 150 M, 149, 242/147 R

[56] References Cited

U.S. PATENT DOCUMENTS

| | | | |
|---|---|---|---|
| 1,940,477 | 12/1933 | Abbott | 242/150 R |
| 1,956,945 | 5/1934 | Easton | 242/150 R X |
| 1,965,363 | 7/1934 | Abbott | 242/150 R X |
| 2,246,989 | 6/1941 | Sparkes | 242/150 R |
| 2,646,944 | 7/1953 | Heffelfinger | 242/150 R |
| 2,930,543 | 3/1960 | Goodhue et al. | 242/150 R |
| 3,633,711 | 1/1972 | Pfarrwaller | 242/150 R X |
| 3,695,548 | 10/1972 | Abbott | 242/150 R |

*Primary Examiner*—Stanley N. Gilreath
*Attorney, Agent, or Firm*—Young & Thompson

[57] ABSTRACT

A static wire tensioning device, of the kind comprising a pair of metal brake shoes between which the wire is clamped at a set pressure, the brake shoes being mounted on respective holders through means allowing to adjust the brake shoe surfaces in perfect parallelism relative to one another. The adjustment is obtained by oscillation of at least one of the shoes around two mutually perpendicular axes. At least one shoe has a central bore through which compressed air is supplied to the clamping surfaces of the shoes.

9 Claims, 2 Drawing Figures

STATIC WIRE TENSIONER FOR COIL WINDING MACHINES

BACKGROUND OF THE INVENTION

1. Field of the Invention

The invention relates to a wire tensioning device, more specifically a static wire tensioner, particularly for use on coil winding machines.

It is known that, in machines for winding metal wire, more particularly enamelled copper wire to form coils for use in an electric and/or electronic field, it is necessary to dispose a tensioner-adapted to keep the tension of the wire being supplied at a substantially constant value—between the supply spool and the wire guide winding the wire.

The wire is usually wound in the axial direction onto the coil, in a substantially free manner, so that a tensioner is essential for tensioning the wire in order to obtain properly wound coils.

The wire tensioning devices at present in use are mainly of two kinds: static and dynamic.

Preferance is frequently given to dynamic tensioners, which have the main advantage of recovering any slack wire released during the operating phases, and also suffer from very little wear.

On the other hand, it is known that dynamic tensioners are completely unsuited for tensioning wires which have to be supplied at high speed and discontinuously, e.g. in the case where square or rectangular coils are being wound, since they may cause irregular winding and damage or break the wire.

As known, these drawbacks are obviated in static tensioners, which usually comprise means for clamping the wire at a set pressure.

2. Description of the Prior Art

The most well-known and widely-used static wire tensioners comprise a pair of oppositely-disposed shoes having, for example a felt, leather or similar surface, between which the wire is clamped at a set pressure. These tensioners are very accurate and efficient when new, but after a relatively short period in operation the wire, which runs in close contact with the shoe surface, forms a grrove thereon, so that the tension cannot be efficiently regulated.

Another and more recent kind of static wire tensioner comprises a bundle of glass fibres having an axis along which the wire moves. The bundle is subjected to torsion around the aforementioned axis with a varying amount of force, thus clamping the metal wire to a varying extent. However, also the latter kind of tensioners soon present the same drawbacks i.e. the metal wire forms a groove as it runs inside the bundle, so that the tension cannot be efficiently regulated.

Other static wire tensioning devices have been studied and proposed but they all have the same drawbacks owing to the relatively rapid wear of the material along which the wire runs.

It is known that attempts have been made to use two oppositely-disposed shoes made of metal and consequently less subject to wear. This method, however, though having a certain advantage in respect of wear, has nevertheless the following drawbacks.

Firstly, it is difficulat to keep the metal shoes exactly parallel, irrespective of the diameter of the wire to be tensioned. In fact, the shoes have to be kept perfectly parallel since otherwise, particularly in the case of thinner wires, there is a risk that the clamping pressure of the shoes may be released at a point of direct contact between the shoes, rather than on the wire to be tensioned.

It has also been found that, at least under certain conditions, the contact under pressure between copper wire—enamelled if required—and metal shoes, results in damage to the shoes as well as the wire, and such damage cannot be neglected.

SUMMARY OF THE INVENTION

The object of the invention, therefore, is to provide a static wire tensioning device which substantially eliminates the problem of wear of the brake shoes and, while using metal shoes, also solves the problem of maintaining exact parallelism and preventing damage to the wire.

These results are obtained basically in that the two metal brake shoes between which the wire is clamped at a set pressure are mounted on respective holders through means allowing to adjust the brake shoe surfaces in perfect parallelism relative to one another, the adjustment being obtained by oscillation of at least one of the shoes around two mutually perpendicular axes.

In a preferred embodiment, a first shoe is mounted so that it can freely oscillate around a vertical pivot carried by a respective holding arm, this latter being caused to oscillate around a horizontal axis under the control of position regulating means.

One result of this feature is that it provides for very accurate means to adjust the vertical axis of the first shoe, so that it is exactly parallel to the stationary vertical axis of the second shoe, taking into account the thickness of the wire to be tensioned therebetween, even if the wire is very thin. Another result is that the horizontal axis of the first shoe is automatically disposed parallel to the horizontal axis of the second shoe, in that the first shoe can freely oscillate around its vertical pivot.

According to another feature of the invention, the brake shoes are made of hard metal and have lapped pressure surfaces.

It has been found that, by adopting the aforespecified arrangement, the following three advantages are obtained:

the pressure on the wire and consequently the tension are absolutely constant;

the wear on the shoes is reduced to a minimum; and the wire is not damaged in any way.

According to another very important feature of the invention, at least one brake shoe, preferably disc-shaped, has a central perforation connected to a compressed-air supply duct.

It has been found that even though the damage to the wire is negligible, the friction between the brake shoes and the wire removes very small surface particles of the enamel for protecting and insulating the copper wire. The particles gradually accumulate in known manner thereby producing either increased friction and thus heating of the shoes or, more particularly, an increase of the actual abrasion effect and hence of the wear on the shoes.

According to the invention, a fluid such as compressed air can be introduced into the space between the two shoes, thus obtaining the following two benefits:

removal of the loosened particles of abrasive enamel; and cooling of the shoe surfaces, thereby eliminating the aforementioned drawbacks.

DESCRIPTION OF THE PREFERRED EMBODIMENT

Other features and advantages of the wire tensioning device according to the invention will be clear from the following description of a preferred embodiment thereof, illustrated by way of example, in the accompanying drawing, in which.

Figure 1:
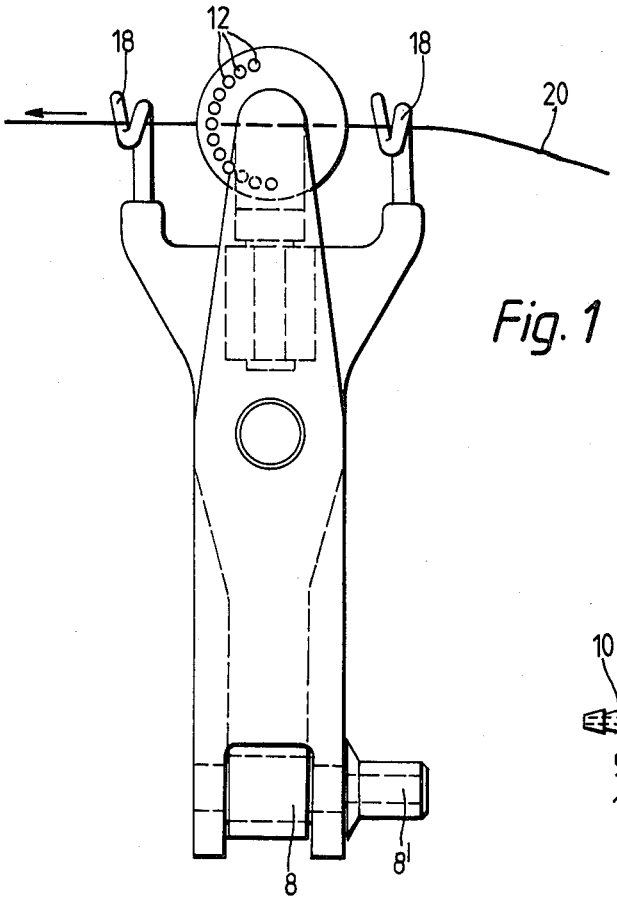
FIG. 1 is a side view of the wire tensioning device.
Figure 2:
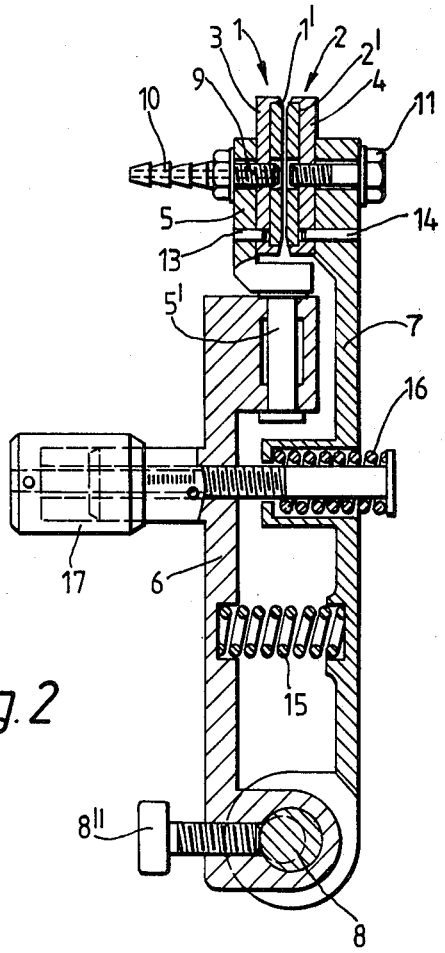
FIG. 2 is an axial section view of the same device.

As shown, the wire tensioner according to the invention comprises a pair of disc-shaped brake shoes 1, 2, each comprising a block 1', 2', secured to a bearing plate 3,4. According to a feature of the invention, the blocks 1' and 2' are made of hard metal and have suitably lapped friction surfaces in mutual contact.

The shoe 1 is rigidly secured to a support 5 which extends downwards into a vertical pin 5' freely rotatable in a recess formed in a first bearing arm 6. The shoe 2 is rigidly secured to a second bearing arm 7. Arms 6 and 7 are secured to one another at their bottom end by means of a pivot 8, which is eccentric in respect of the axis of a button 8', through which latter it can be precisely adjusted in position. A clamping screw 8'' blocks the pivot 8 in the adjusted position.

According to an important feature of the invention the shoe 1 has a central bore receiving the end of a screw 9, which is axially bored and provided with a connection 10 for a compressed-air supply pipe system. The shoe 2 is secured to arm 7 by an ordinary screw 11, but also this latter can have a connection for a compressed-air supply pipe system.

Shoes 1 and 2 both have small peripheral apertures 12 receiving pins 13, 14, for holding the shoes in angular position on their support.

Between the two bearing arms 6, 7, there is a first spring 15 which tends to prevent the arms and thus the shoes, from approaching, and a second spring 16, stronger than the first and the clamping action of which is accurately calibrated by a micrometer vernier 17.

The wire tensioner also comprises two pig-tail arms 18 which guide the wire 20 in known manner along a horizontal line extending through the centre of shoes 1 and 2.

The operation of the wire tensioner is simple and will already be clear from the preceding description.

The two shoes 1, 2, are disposed in completely parallel relationship, both horizontally, by free oscillation of the shoe 1 around the vertical axis since it is mounted on the idle pivot 5', and vertically, by rotation of shoe 1 around the horizontal axis, through adjustment of the eccentric pivot 8, so that arm 6 oscillates with respect to arm 7 which is fixedly mounted on the machine frame. Alternatively, arm 6 can be fixed whereas arm 7 can be caused to oscillate by adjustment of pivot 8. In the latter case, the shoe 1 rotates only around its vertical axis whereas the shoe 2 oscillates around its horizontal axis.

The adjustment through pivot 8 can be facilitated by a reference scale connected to the button 8' and graduated so as to correspond directly to the cross-section of the wire 20.

Of course, in the above description, reference has been made only to horizontal and vertical axes, taking into account the fact that the wire 20 normally runs along a horizontal alignment. In the event, however, that the wire should run according to a vertical alignment, or to a different alignment, this terminology will have to be changed: generally, horizontal and vertical axes will thus be axes lying parallel and perpendicular to the wire alignment.

Finally, the clamping pressure of shoes 1, 2, is adjusted by means of the spring 16 and vernier 17 according to the desired conditions for braking the wire 20.

Compressed-air is then introduced through duct 10 throughout the whole time in which the wire 20 is running between the shoes.

When the shoes show traces of wear, which is inevitable after a relatively long period of use, it is advisable to rotate shoes 1, 2, around their transverse common axis and to secure them in a different angular position, by engaging pins 13, 14, in different apertures 12.

When the wear on the shoes has extended to most of the friction surface, the hard metal blocks 1', 2', can be replaced on the respective holding plates 3, 4.

Of course, the invention is not limited to the particular embodiment shown, but numerous alternative variants and arrangements are possible. More particularly, as already stated, arm 7 can be fixed and arm 6 can be rotated relative thereto, with oscillation of shoe 1 on two perpendicular axes, or alternatively, arm 6 can be held in position and arm 7 can be adjusted relative thereto, each shoe oscillating around one perpendicular axis. Alternatively, use can be made of brake-pressure adjustment means differing from the combination of springs 15, 16, without thereby departing from the protection scope of the present invention.

I claim:

1. In a winding machine for winding coils of metallic wire for electrical or electronic use, a static wire tensioning device comprising a first friction shoe mounted fixedly on a first bearing arm, a second friction shoe, a second bearing arm, means mounting said second friction shoe on said second bearing arm for freely oscillating around an axis perpendicular to the sliding direction of the wire, means for mounting said two bearing arms rotatable one with respect to the other about an axis parallel to the sliding direction of the wire and for finely adjusting the mutual distance of said bearing arms at a distance from the friction shoe, and spring means acting on said arms for pushing said friction shoes one toward the other with finely adjusted force.

2. Apparatus as claimed in claim 1, said means for finely adjusting the mutual distance of the bearing arms comprising an eccentric pivot on which is rotatably mounted the end of one of the arms opposite the end bearing the friction shoe.

3. Apparatus as claimed in claim 1, the first mentioned axis being parallel to the friction face of said first friction shoe.

4. Apparatus as claimed in claim 1, one of said shoes having a central bore that opens into the space between said shoes, and means to supply fluid under pressure to said bore.

5. Apparatus as claimed in claim 4, in which said fluid is compressed air.

6. Apparatus as claimed in claim 1, and second spring means urging the shoes apart, the first-mentioned spring means being stronger than said second spring means.

7. Apparatus as claimed in claim 1, in which the pressure surfaces of brake shoes are made of hard metal and lapped.

8. Apparatus as claimed in claim 7, each shoe comprising a bearing plate to which a block of hard metal having a lapped surface is releasably secured.

9. Apparatus as claimed in claim 1, in which the brake shoes are in the form of two parallel discs, means mounting the discs for rotation about their axes, and means for selectively fixing each disc in any of a plurality of rotated positions of adjustment.

* * * * *